US006477854B2

(12) United States Patent
Chung et al.

(10) Patent No.: US 6,477,854 B2
(45) Date of Patent: Nov. 12, 2002

(54) SMALL AIR CONDITIONER AND DEHUMIDIFYING DEVICE BY USING THE SAME

(75) Inventors: Moon Kee Chung, Seoul (KR); In Hwa Chung, Seoul (KR); Sim Won Chin, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/770,213

(22) Filed: Jan. 29, 2001

(65) Prior Publication Data

US 2002/0029583 A1 Mar. 14, 2002

(30) Foreign Application Priority Data

Sep. 8, 2000 (KR) ..... 2000-53447
Sep. 8, 2000 (KR) ..... 2000-53448
Sep. 28, 2000 (KR) ..... 2000-57015

(51) Int. Cl.[7] ..... F25B 47/00
(52) U.S. Cl. ..... 62/280; 62/507
(58) Field of Search ..... 62/507, 508, 280, 62/511

(56) References Cited

U.S. PATENT DOCUMENTS 2,320,436 A * 6/1943 Hull ..... 62/262
3,394,563 A * 7/1968 Schwing ..... 62/511
4,321,803 A * 3/1982 Smith ..... 165/125
4,434,841 A * 3/1984 Jackson et al. ..... 165/125
4,911,234 A * 3/1990 Heberer et al. ..... 165/125
5,117,656 A * 6/1992 Keck et al. ..... 417/360
6,318,108 B1 * 11/2001 Holstein et al. ..... 62/279

* cited by examiner

*Primary Examiner*—William E. Tapolcai
(74) *Attorney, Agent, or Firm*—Birch, Stewart, Kolasch & Birch, LLP

(57) ABSTRACT

Small air conditioner including a heat discharging part including a body having an air inlet in a side and an air outlet in a top surface, a condenser fitted close to an inside of the air inlet, a fan fitted under the air outlet, and a compressor fitted under the fan, wherein external air flows into the heat discharging part through the air inlet, heat exchanged at the condenser, cools down the compressor, and discharged through the air outlet, thereby permitting convenient installation and moving.

7 Claims, 8 Drawing Sheets

SMALL AIR CONDITIONER AND DEHUMIDIFYING DEVICE BY USING THE SAME

BACKGROUND OF THE INVENTION

1. Field of the Invention

The present invention relates to an air conditioner, and more particularly, to a small air conditioner, of which installation and moving are convenient, and a dehumidifying device which can remove moist from a room effectively while a temperature of an air conditioning space is not dropped.

2. Background of the Related Art

The air conditioner maintains a temperature, a humidity, and the like of a desired space (air conditioned space) at an appropriate state by using a refrigerating cycle of compression, condensation, expansion, and evaporation of a refrigerant. In the air conditioners, there are package type air conditioners and room air conditioners. In general, the air conditioner has a heat discharging part with a condenser and a heat absorbing part with an evaporator arranged in separate places. In general, though a compressor and an expansion valve are provided to the heat discharging part, sometimes, the compressor and the expansion valve are provided to the heat absorbing part. And, since the heat discharging part is arranged outside of the room, the heat discharging part is called as an outdoor unit, and, since the heat absorbing part is arranged inside the room, the heat absorbing part is called as an indoor unit. A related art room air conditioner will be explained with reference to FIGS. 1 and 2.

A heat discharging part 5 is placed outside of the room, and the heat absorbing part 3 is placed inside of the room. For an example, the heat absorbing part 3 is Axed to a wall 11, and the heat discharging part 5 is placed on a veranda or the like. There are refrigerant pipe lines connected between the heat absorbing part 3 and the heat discharging part 5 for flow of the refrigerant. That is, there are a high pressure pipeline 7*a* and a low pressure pipeline 7*b* between the condenser and the evaporator. And, there is a drain hose 9 connected to the heat absorbing part 3 for discharging condensate formed at the evaporator of the heat absorbing part 3.

A system of the heat absorbing part 3 will be explained. The heat absorbing part 3 is provided with an evaporator 37 and a fan 38 fitted inside thereof for cooling room air. And, there is a suction grill 33 in a front portion of a body 31 of the heat absorbing part, for drawing air from the room, and a discharge grill 35 in a substantially bottom portion of the body 31 of the heat absorbing part, for discharging cooled air heat exchanged at the evaporator 37 into the room again.

The heat discharging part 5 will be explained with reference to FIGS. 3A and 3B.

There is an "L" formed condenser in rear of the body 51. That is, the condenser 52 is provided extended from the rear of the body 51 to one side thereof. And, there is an axial fan 54 in front of the condenser 52 for causing a flow, which is driven by a motor 55 mounted on a motor mount 57. There is a separate space in one side portion of the body 51, where the compressor 59 is provided.

The operation of the related art air conditioner will be explained, with reference to FIGS. 1 to 3.

The room air flowed into the suction grill 33 is cooled down as the room air is heat exchanged at the evaporator 37, and discharged into the room again, for maintaining the room at a preset temperature. The evaporated refrigerant is provided to a compressor in the heat discharging part 5 through the low pressure pipeline 7*b,* and compressed and provided to the condenser. The refrigerant makes heat exchange with external air at the condenser, so that the refrigerant is condensed, and air is heated and discharged outside of the room. The condensed refrigerant is expanded at an expansion valve and flows to the evaporator 37 through the high pressure pipeline 7*a,* again. By repeating the foregoing process, the room, i.e., the air conditioned space 1, can be maintained at a desired temperature.

In the meantime, there are water drops formed on a surface of the evaporator 37 during heat exchange between the room air and the refrigerant at the evaporator 37 in the heat absorbing part 3, because a surface temperature of the evaporator 37 is very low compared to the room temperature, so as to cool down the room air in contact with the evaporator 37 below a dew point of the air. The water drops formed at the evaporator 37 are collected to one place following a drain channel 39 in the heat absorbing part 3, and drained to outside of the room through the drain hose 9.

Next, the dehumidifying operation will be explained. Basically, the dehumidifying operation by using an air conditioner is a cooling operation. That is, as explained, by removing the condensate condensed on the evaporator during the cooling operation, an effect of moisture removal from the room can be obtained, at the end.

However, the related art air conditioner has the following problems.

First, the related art air conditioner in general is bulky and heavy, and the refrigerant pipeline of copper are passed through a wall and fitted to a desired location. Accordingly, once the heat discharging part and the heat absorbing part are installed to one location, moving the heat discharging to other place has been difficult, actually. Therefore, an instant cooling of, not an entire air conditioning space, but a particular space, has been impossible.

Second, as explained, the related art dehumidifying operation is the same with the cooling operation, actually. Therefore, in the dehumidifying operation, not only the moisture is removed, but also a temperature of the air conditioning space is dropped, inevitably. According to this, the user feels unpleasant cold coming from the unwanted temperature drop. And, even during the dehumidifying operation, upon reaching to a preset temperature, the air conditioner stops the cooling operation and only blows air, without dehumidification. That is, a continuous dehumidification by using the related art air conditioner is difficult, actually.

SUMMARY OF THE INVENTION

Accordingly, the present invention is directed to a small air conditioner that substantially obviates one or more of the problems due to limitations and disadvantages of the related art.

An object of the present invention is to provide a small air conditioner which can be installed and moved with easy, and improve a cooling performance.

Another object of the present invention is to provide a dehumidifying device which can remove moisture from a room effectively while a temperature in the air conditioning space is prevented from dropping.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the heat discharging part in an air conditioner includes a body having an air inlet in a side and an air outlet in a top surface, a condenser fitted close to an inside of the air inlet, a fan fitted under the air outlet, and a compressor fitted under the fan, wherein external air flows into the heat discharging part through the air inlet, heat exchanged at the condenser, cools down the compressor, and discharged through the air outlet, thereby permitting an easy installation and moving, and improving a performance of the heat discharging part.

In another aspect of the present invention, there is provided a small air conditioner including a heat discharging part having a small sized condenser, a heat absorbing part having a small sized evaporator, a high pressure pipeline having a diameter below a present value connected between the condenser and the evaporator, and a low pressure pipeline connected between the evaporator and the compressor, wherein refrigerant from the condenser expands as the refrigerant flows through the high pressure pipeline, thereby simplifying a structure of the air conditioner and permitting to provide a small sized air conditioner.

In further aspect of the present invention, there is provided an air conditioner including a heat absorbing part having an evaporator, for discharging a low temperature air heat exchanged at the evaporator, and a heat discharging part having a condenser, for discharging a high temperature air heat exchanged at the condenser to a direction of the low temperature air discharged from the heat absorbing part, thereby removing moisture without dropping a temperature of an air conditioning space as the high temperature air from the heat discharging part and the low temperature air from the heat absorbing part are mixed.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
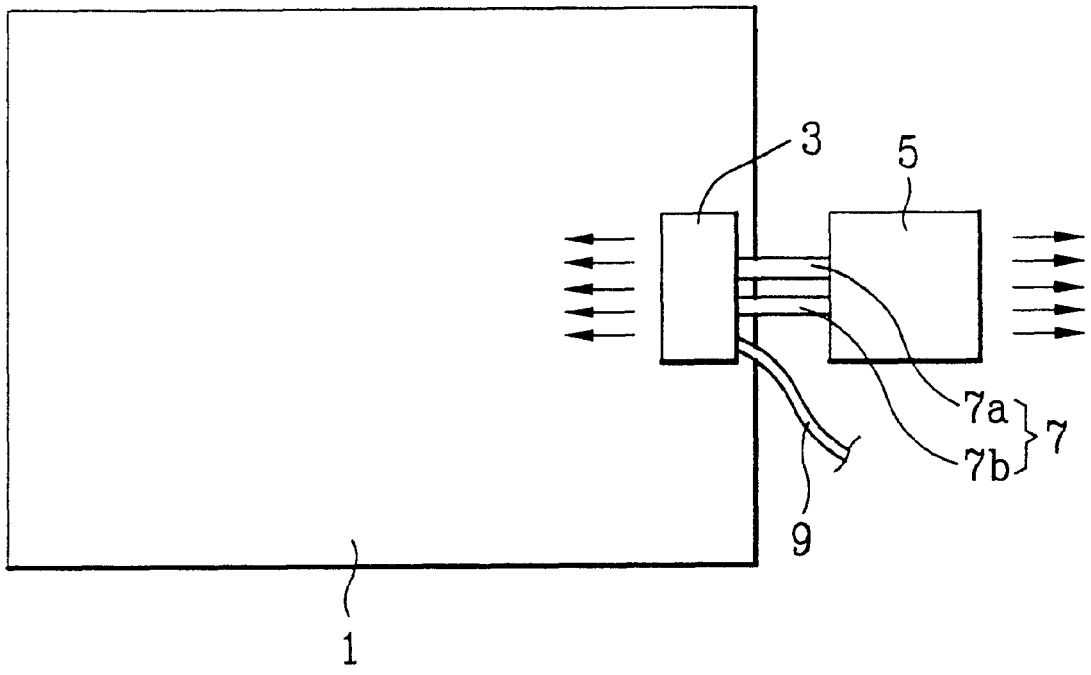
FIG. 1 Related Art
FIG. 1 schematically illustrates an installation configuration of a related art air conditioner.
Figure 2:
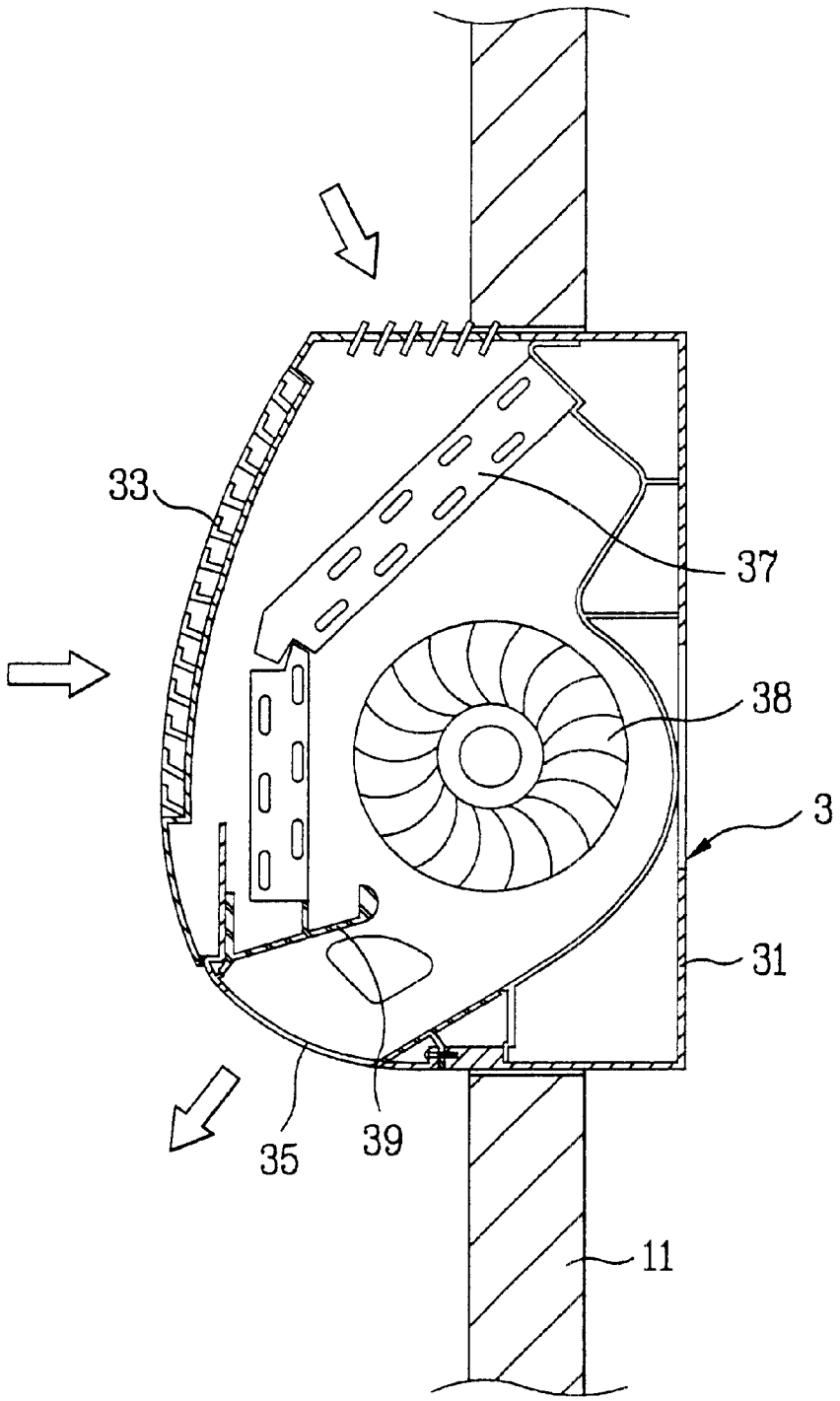
FIG. 2 Related Art
FIG. 2 illustrates a section of a heat absorbing part(indoor unit) of a related art air conditioner.
Figure 3A:
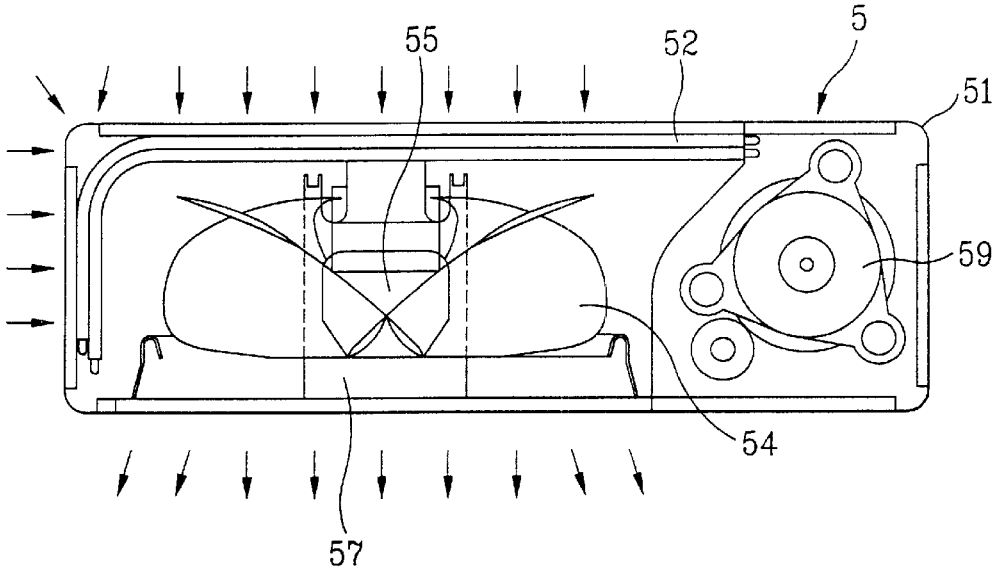
FIG. 3A Related Art
FIG. 3A illustrates a cross section of a heat discharging part(outdoor unit) of a related art air conditioner.
Figure 3B:
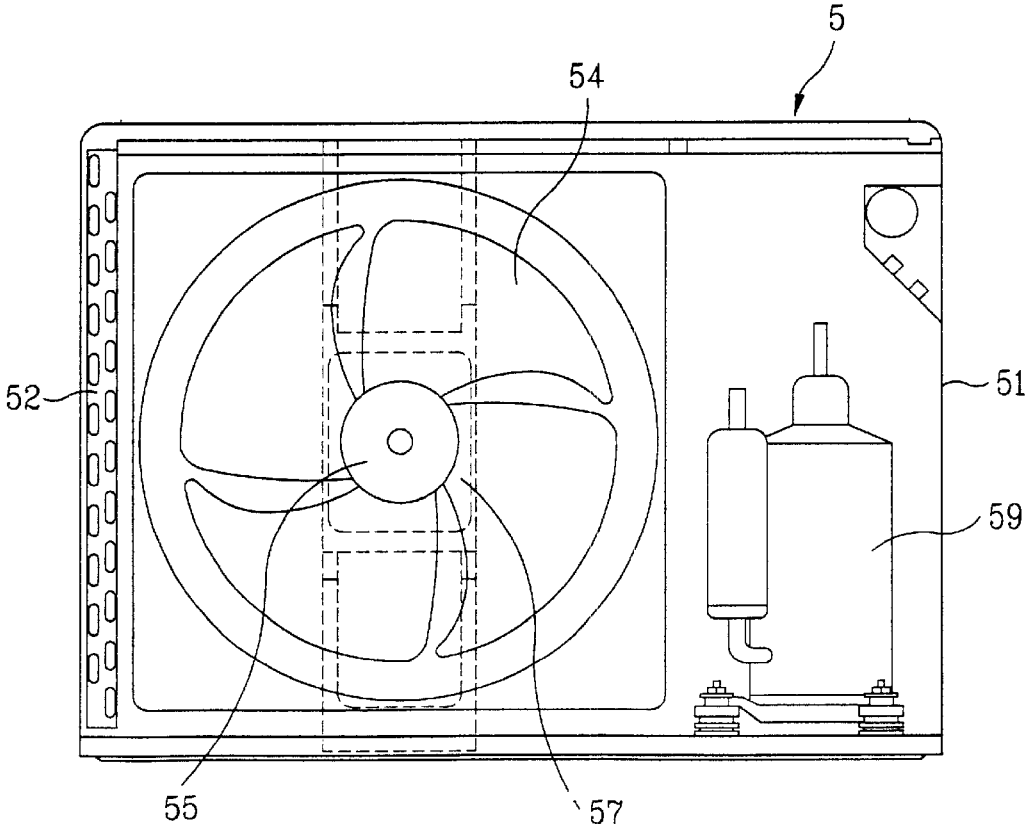
FIG. 3B Related Art
FIG. 3B illustrates a longitudinal section of FIG. 3A.

Reference will now be made in detail to the preferred embodiments of the present invention, examples of which are illustrated in the accompanying drawings. An air conditioner in accordance with a preferred embodiment of the present invention will be explained with reference to FIG. 4. Alike the related art air conditioner, the small air conditioner of the present invention also includes a compressor, a condenser, an expansion valve, an evaporator and the like, for employing the refrigerating cycle. Of course, the condenser is in the heat discharging part 100, and the evaporator is in the heat absorbing part 200. Since an object of the small air conditioner of the present invention lies on cooling a local space, an air conditioner with a small cooling capacity is acceptable, it is preferable that sizes and weights of respective components in the air conditioner are reduced. Moreover, it is preferable that the high pressure pipeline 310 and the low pressure pipeline 320 are formed of flexible material for improving the convenience in moving and installation of the air conditioner, and detachably connected between the heat absorbing part 200 and the heat discharging part 100 by means of quick coupling or the like, for easy installation and moving of the heat absorbing part 200 and the heat discharging part 100. On the other hand, in the related art, one end of the drain hose 330 is connected to the heat absorbing part 200, and the other end is exposed to outside of the room for discharging the condensate from the evaporator to outside of the room. However, it is preferable for the small air conditioner of the present invention that the other end of the drain hose 330 is connected to the heat discharging part 100, because, as the heat discharging part 100 is in general installed outside of the room, it is convenient in view of installation that the condensate is transferred to the heat discharging part 100 and discharge the condensate to outside of the room therefrom. It is of course preferable that the drain hose 330 is also formed of a flexible material. It is preferable that a pump(not shown) is provided to the heat absorbing part 200 for an efficient transfer of the condensate from the heat absorbing part 200 to the heat discharging part 100, for pumping the condensate from the heat absorbing part 200 to the heat discharging part 100, because there can be an occasion that the heat absorbing part 200 can be installed at a lower position than the heat discharging part 100, as installation and moving both of the heat discharging part 100 and the heat absorbing part 200 are easy. By the way, if the condensate is, not discharged to outside of the room directly, but provided to the heat discharging part 100, for cooling down the condenser 112, an efficiency of the air conditioner can be improved.

The foregoing system of the small air conditioner of the present invention facilitate comparatively easy installation and moving of the air conditioner. However, the heat discharging part merely made smaller while keeping the system the same with the related art has the following problems.

First, the related art heat discharging part has an axial fan in one side portion of the body, and a compressor in the other side portion of the body, to form a thin and wide heat discharging part body on the whole, with a center of gravity in the compressor side, which is not convenient for transportation.

Second, in the related art heat discharging part, external air flows in from a rear side(a portion the condenser is fitted) and discharged from a front side(a portion the axial fan is fitted). Therefore, it is required to install the heat discharging part such that the rear side thereof is away from a wall for a certain extent, because, if there is too small gap between the rear side of the heat discharging part and the wall, a flow rate is reduced and noise and vibration is occurred, to deteriorate a performance of the heat discharging part, that limits a position and fashion of installation of the heat discharging part.

Figure 4:
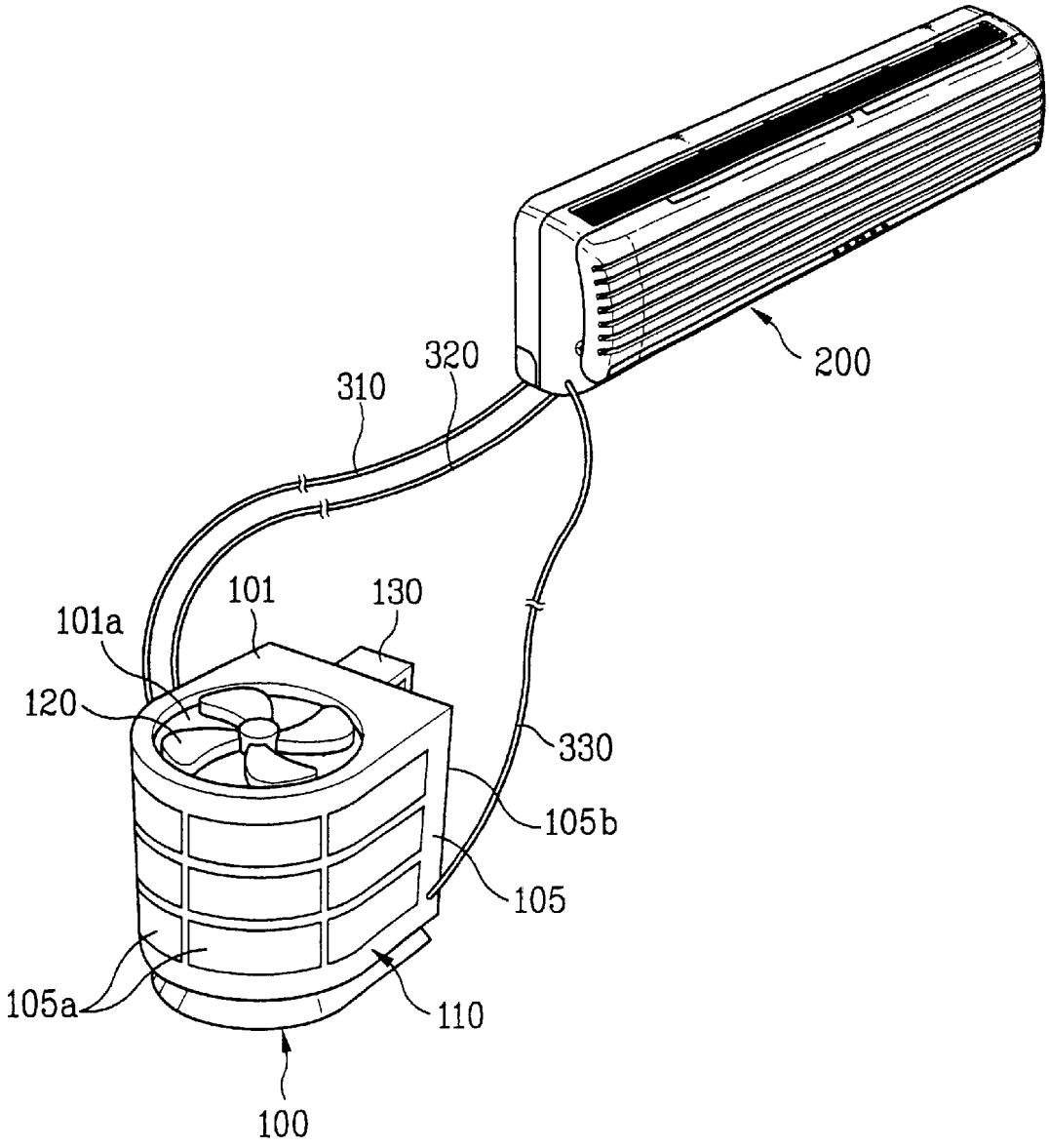
FIG. 4 illustrates a perspective view of a small air conditioner in accordance with a first preferred embodiment of the present invention.
Figure 5:
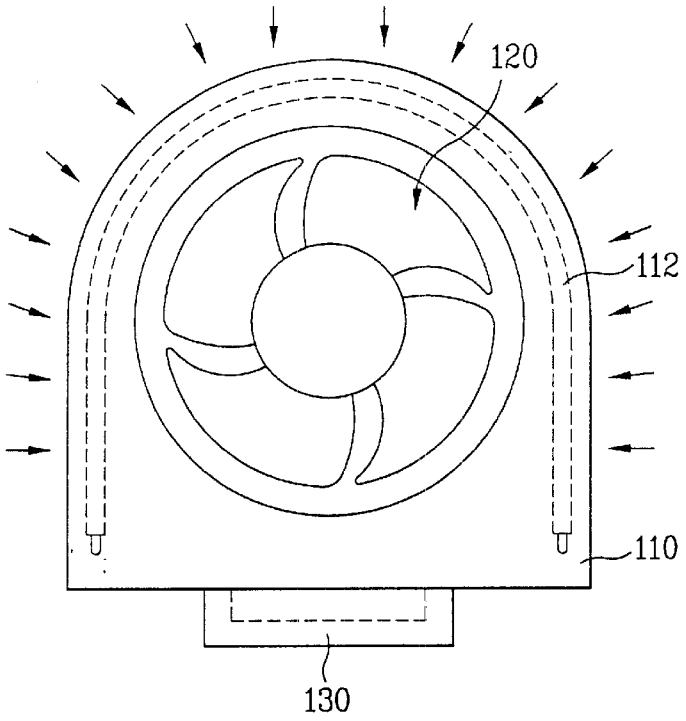
FIG. 5 illustrates a plan view of the heat discharging part of the air conditioner in FIG. 4.
Figure 6:
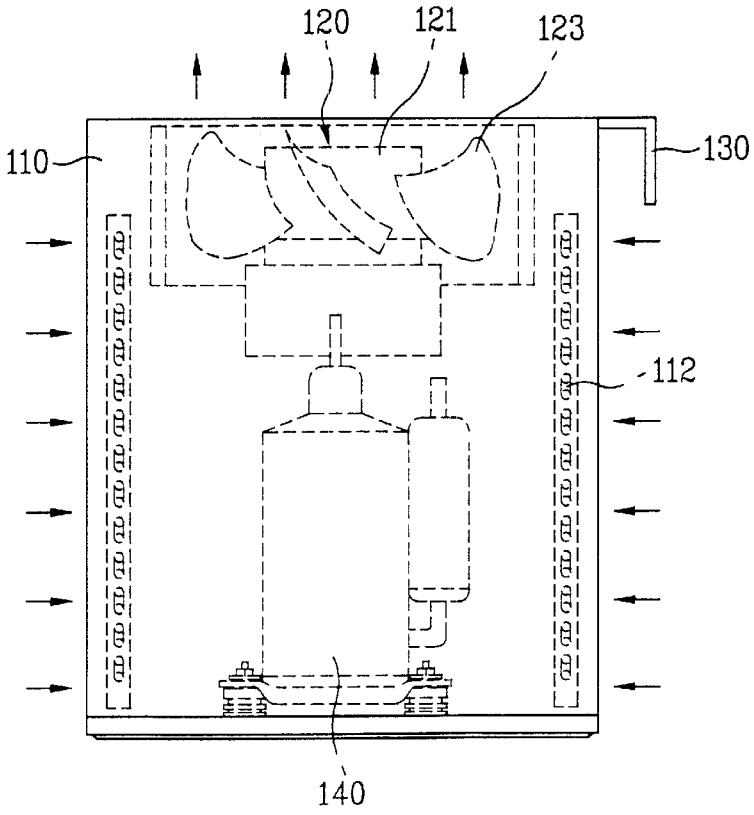
FIG. 6 illustrates a longitudinal section of the heat discharging part in FIG. 4.

Accordingly, the following heat discharging part of the air conditioner of the present invention improves the disadvantage, which will be explained with reference to FIGS. 4~6.

A body 110 of the heat discharging part 100 has an air inlet 105*a* and an air outlet 101*a*. Though the body of the related art heat discharging part has an air inlet and an air outlet in side surfaces of the body, the body 110 of the present invention has the air outlet 101*a* in a top surface and the air inlet 105*a* in the side surface 105. The air inlet 105*a* in the side surface 105 of the body 110 may be formed throughout the entire side surface 105, it is preferable that a portion of the side surface is closed, for installation of the heat discharging part 100 close to a wall surface, to provide three opened faces and one closed face if the body 110 is hexahedral. It is favourable that the three opened faces form a "U" face in view of smooth air flow, and the closed face 105*b* has a coupling means 130. Though an "L" type bend is shown as the coupling means 130 in this embodiment, the coupling means 130 is not limited to this one.

In the meantime, the condenser 112, the fan 120, the compressor 140 are fitted inside of the body 110. In detail, the condenser 112 is fitted near to the air inlet 105*a* of the body 110, the fan 120 is fitted to near to the air outlet 101*a*, and the compressor 140 is fitted below the fan 120. It is preferable that a motor integrated axial fan is employed as the fan 120. That is, an out rotor motor is fitted to a center of a hub 121, and a plurality of vanes 123 are fitted to an outer circumference of the hub 121. Use of the motor integrated axial fan can dispense with the motor mount, to facilitate a vibration reduction, compact design of the body 110, and easy disassembly for repair.

The operation of the heat discharging part of this embodiment will be explained.

Upon putting the fan 120 into operation, external air flows into the body 110 of the heat discharging part through the air inlet 105*a* in the side. The air flows through the condenser 112, and around the compressor 140, and discharged again through the air outlet 101*a* in the top surface, to cool down the compressor 140, that enhances an efficiency of the compressor 140. And, the condensate from the heat absorbing part 200 cools down the condenser 112, an efficiency of the condenser 112 is also enhanced. Moreover, since the external air flows into an inside of the heat discharging part through the air inlet 105*a* formed in most of the side surfaces of the heat discharging part 105*a*, a required power for the fan 112 is reduced and a flow rate is increased.

Figure 7:
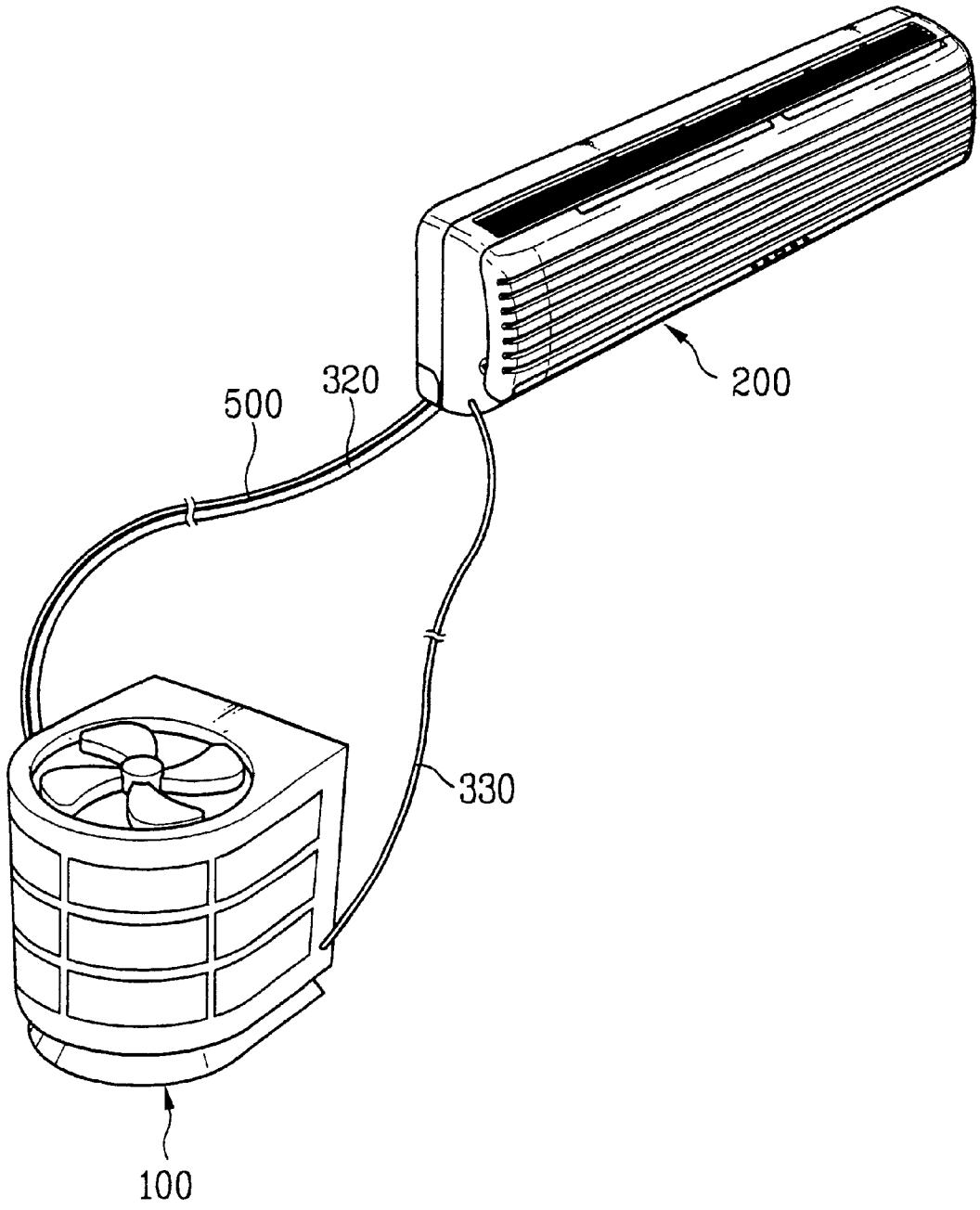
FIG. 7 illustrates a perspective view of a small air conditioner in accordance with a second preferred embodiment of the present invention.

A small air conditioner in accordance with a second preferred embodiment of the present invention will be explained, with reference to FIG. 7.

The second embodiment is similar to the first embodiment, except that the expansion valve in the related art is not used. That is, a diameter of the high pressure pipeline 500 connecting the condenser and the evaporator is reduced below a preset size, to serve as the high pressure pipeline as well as the expansion valve on the same time. In detail, no expansion valve is used, but the diameter of the high pressure pipeline 500 is reduced, for expanding the refrigerant from the condenser by the capillary tube phenomenon during the refrigerant flows through the high pressure pipeline. This combination of the high pressure pipeline with the expansion valve is possible because the small air conditioner has a small refrigerant flow rate through the high pressure pipeline. And, in general, though a length of the high pressure pipeline in a domestic air conditioner is over 5*m*, since the length of the high pressure pipeline in a small air conditioner can be comparatively short, for an example around 2*m*, the high pressure pipeline can be combined with the expansion valve.

In the meantime, it is possible that the length of the high pressure pipeline 500 is made the same with a length of the low pressure pipeline 310 by adjusting a diameter of the high pressure pipeline. The same lengths of the high pressure pipeline 500 and the low pressure pipe line 310 simplifies laying the pipelines 500 and 310.

Figure 8:
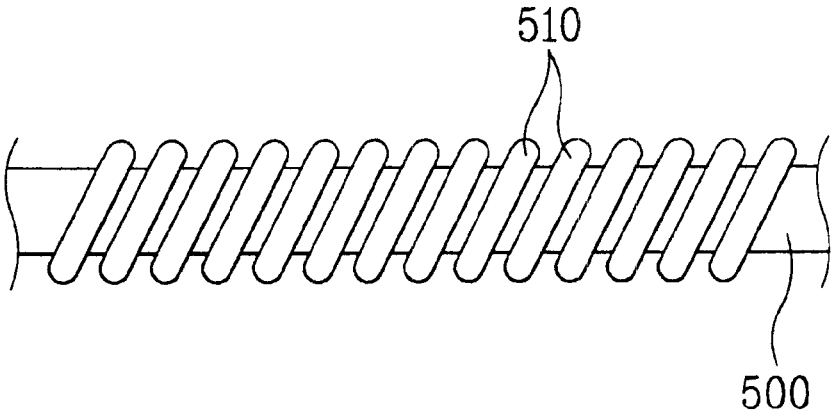
FIG. 8 illustrates a perspective view of an expansion valve integrated type high pressure pipeline in accordance with a preferred embodiment of the present invention.
Figure 9:
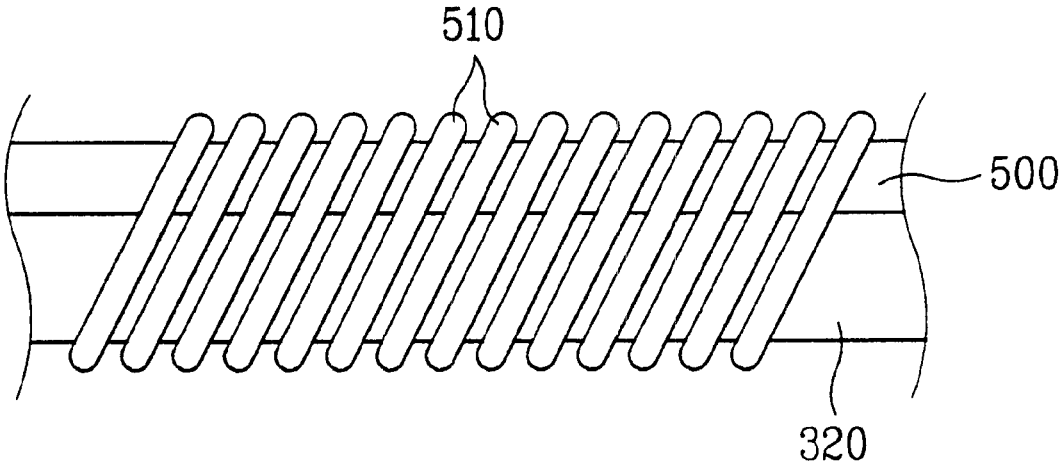
FIG. 9 illustrates a perspective view of an expansion valve integrated type high pressure pipeline in accordance with another preferred embodiment of the present invention; and, FIG. 10 illustrates a perspective view showing a principle of dehumidifying method of the present invention.

In the meantime, it is preferable that pipe protecting means is provided around the high pressure pipeline 500, because the small diametered combined high pressure pipeline 500 and the expansion valve is susceptible to breakage. There are a variety of the pipe protecting means. For an example, as shown in FIG. 8, a metal cable 510 may be wound around the high pressure pipeline 500 in a form of a spring. Of course, the pipe protecting means is not limited to this, and, for an example, the high pressure pipeline may be surrounded by a protecting pipe. Or as shown in FIG. 9, both the high pressure pipeline 500 and the low pressure pipeline 320 are wound with a metal cable 510 as one unit. The combined expansion valve and high pressure pipeline of the present invention can be applicable, not only to a case the compressor is fitted to the heat discharging part 100, but also to a case the compressor is fitted to the heat absorbing part 200.

Figure 10:
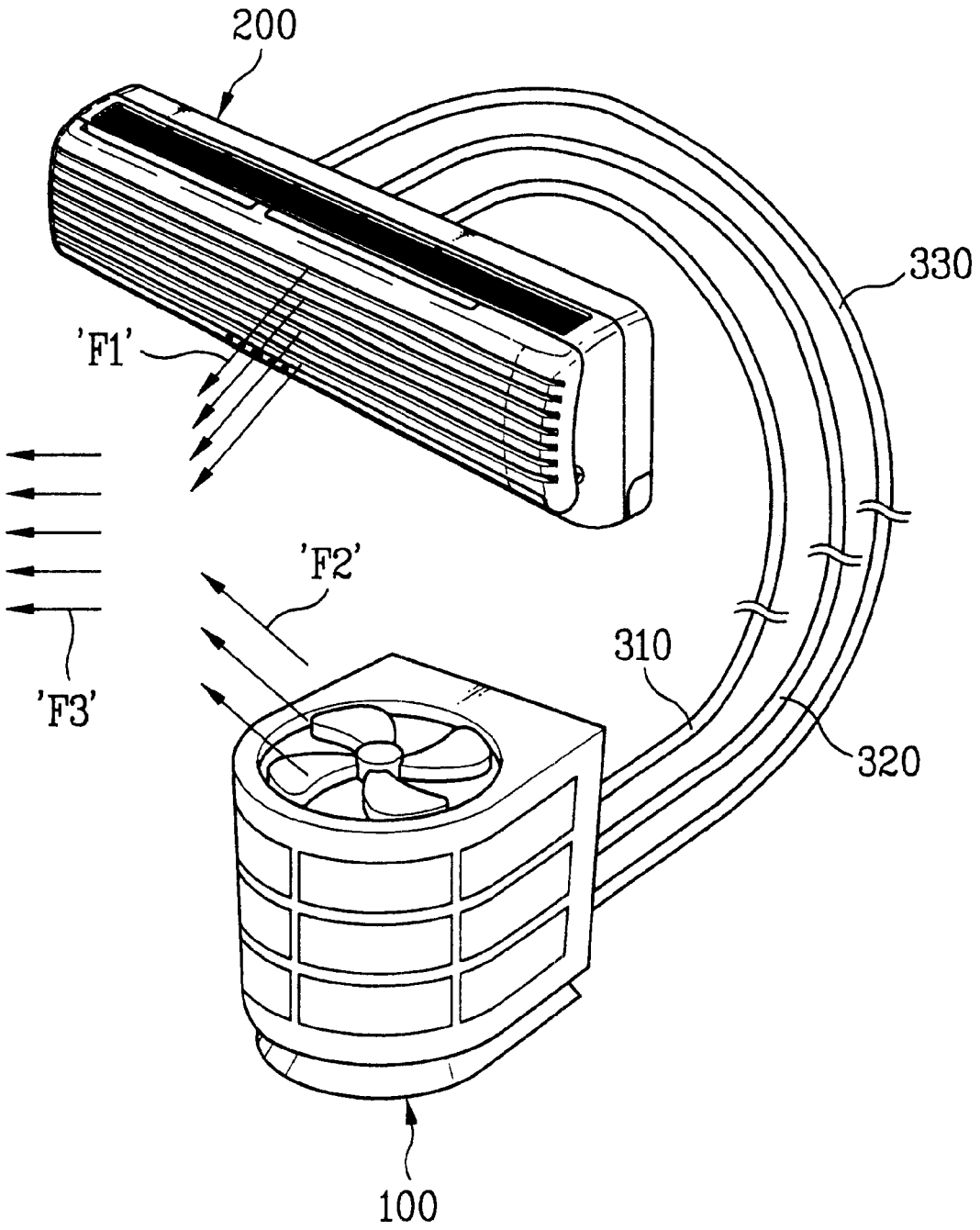

The principle of dehumidification by using the air conditioner of the present invention will be explained, with reference to FIG. 10.

Basically, in the dehumidification of the present invention too, the moisture is removed by removing condensate condensed at the evaporator. However, the dehumidification of the present invention can maintain a room temperature constant while the moisture in the room is removed by mixing air at a relatively high temperature discharged from the heat discharging part 100 and air at a relatively low temperature discharged from the heat absorbing part 200. Therefore, the present invention is applicable to an air conditioner of which installation and moving, and coupling and separation of the heat discharging part 100 and the heat absorbing part 200 are easy. Of course, the present invention is applicable to a case the heat discharging part 100 and the heat absorbing part are stationary. The dehumidification of the present invention will be explained in detail.

The heat discharging part 100 and the heat absorbing part 200 are arranged such that directions of air flow both from the heat discharging part 100 and the heat absorbing part 200 are substantially the same. It is easy to arrange the heat discharging part 100 and the heat absorbing part 200 in a fashion described above by using the small air conditioner. Of course, the heat discharging part 100 and the heat absorbing part 200 may be integrated into one unit. Moist laden air flows into the heat absorbing part 200, the moist laden on the air is condensed at the evaporator, and the condensate is drained through the drain hose 330 to outside of the room. And, the cooled air F1 is discharged into the room again through the air outlet in the air absorbing part 200. In this instance, the heat discharging part 100 discharges air at a comparatively high temperature F2 heat exchanged at the condenser in the direction of cooled air, to mix and heat exchange between the comparatively low temperature air F1 and the comparatively high temperature air F2. That is, since the mixed air F3 is at a temperature almost the same with a room temperature, the room can be maintained at a comparatively constant temperature. At the end, the dehumidification of the present invention can maintain the room temperature with the moist in the room is removed. And, since there is almost no room temperature change, operation of the air conditioner is continuous, to facilitate continuous moist removal.

In the meantime, in order to use the air conditioner as a dehumidifying device as well as cooling or heating device, it is preferable that the heat discharging part 100 or the heat absorbing part 200 has a flow controlling, means for controlling a flow rate discharged therefrom. Of course, the flow controlling means may be provided to the heat discharging part 100 and the heat absorbing part 200, respectively. What is required for the flow controlling means is an appropriate adjustment of an extent of opening the air outlet, of which explanation will be omitted as the means is known to a skilled person in this art. In the foregoing system, if a flow rate from the heat absorbing part 200 is set greater than the flow rate from the heat discharging part 100, cooling on the same time with dehumidification can be made possible. And, in an opposite case, heating on the same time with dehumidification can be made possible.

As has been explained, the small air conditioner and the dehumidifying device by using the same of the present invention have the following advantages.

First, as installation, moving and storage are easy, space can be used effectively.

Second, since a center of gravity of the heat discharging part is not deviated from the center, vibration caused by compressor operation can be reduced. And, the use of motor integrated type axial fan can dispense with a motor mount, that again reduces vibration. Air can be drawn efficiently, and which cools down the compressor. The condensate cools the condenser, that improves an efficiency of the heat discharging part.

Third, the small air conditioner of the present invention requires no separate expansion valve. Therefore, the heat discharging part(outdoor unit) and the heat absorbing part (indoor unit) can be made smaller and lighter, to allow an intensive and quick cooling of, not an entire space, but a particular space. Accordingly, the air conditioner of the present invention can be used as a small air conditioner. And, the flow of the refrigerant from the condenser, not through a separate expansion valve, but the combined expansion valve and high pressure pipeline, can reduce a pressure loss coming from the refrigerant flow, to prevent deterioration of performance and efficiency of the air conditioner. A production cost of the air conditioner can be reduced since no separate expansion valve is required.

Fourth, the air conditioner of the present invention can remove moist effectively, without dropping a room temperature, which permits the user feel comfortable. And, by controlling flow rates from the heat discharging part and the heat absorbing part, dehumidification and cooling or heating can be made on the same time.

It will be apparent to those skilled in the art that various modifications and variations can be made in the small air conditioner and the dehumidifying device by using the same of the present invention without departing from the spirit or scope of the invention. Thus, it is intended that the present invention cover the modifications and variations of this invention provided they come within the scope of the appended claims and their equivalents.

What is claimed is:

1. A heat discharging part in an air conditioner comprising:

a body having an air inlet in a side and an air outlet in a top surface;

a condenser fitted close to an inside of the air inlet;

a fan fitted under the air outlet;

a compressor fitted under the fan;

a high pressure pipeline, having a diameter less than a preset value, connected to the condenser for communicating refrigerant between the condenser and an evaporator of a heat absorbing part;

a low pressure pipeline connected to the compressor for communicating refrigerant between the compressor and the evaporator, wherein due to a small size of the condenser, refrigerant expands as the refrigerant flows through the high pressure pipeline, such that the heat discharging part does not use a dedicated expansion valve; and a metal protecting layer surrounding the high pressure pipeline, wherein external air which rows into the heat discharging part through the air inlet, is heat exchanged at the condenser, cools down the compressor, and is discharged through the air outlet, wherein the body has one closed face, and wherein the closed face has a coupling means for fixing the heat discharging part at a desired location.

2. The heat discharging part as claimed in claim 1, wherein the fan is a motor integrated axial fan.

3. The heat discharging part as claimed in claim 1, wherein the heat discharging part has a drain hose having one end connected thereto for transferring condensate from a heat absorbing part to the heat discharging part, and the heat discharging part has a pump for drawing the condensate.

4. The heat discharging part as claimed in claim 3, wherein the condensate is discharged over the condenser to dampen the condenser and improve the cooling efficiency of the condenser.

5. The heat discharging part as claimed in claim 1, wherein the metal protecting layer also surrounds the low pressure pipeline.

6. The heat discharging part as claimed in claim 1, wherein the metal protecting layer is a metal cable wound in a form of a spring around the high pressure pipeline.

7. The heat discharging part as claimed in claim 1, wherein the condenser is approximately U-shaped.

* * * * *